United States Patent [19]

Cameron

[11] Patent Number: 4,961,294

[45] Date of Patent: Oct. 9, 1990

[54] TELEPHONE ENCLOSURE

[76] Inventor: Robert J. Cameron, 6 Sedgwick Rd., Carmel, N.Y. 10512

[21] Appl. No.: 367,878

[22] Filed: Jun. 19, 1989

[51] Int. Cl.[5] ..... E04H 1/14

[52] U.S. Cl. ..... 52/27; 52/28; 52/36

[58] Field of Search ..... 52/27, 36, 73, 823, 52/826, 28; 312/223

[56] References Cited

U.S. PATENT DOCUMENTS

| | | | |
|---|---|---|---|
| D. 250,602 | 12/1978 | Ambrosio et al. . | |
| D. 257,416 | 10/1980 | King, Sr. . | |
| D. 263,101 | 2/1982 | George et al. . | |
| D. 273,637 | 5/1984 | Benedetti et al. . | |
| D. 275,632 | 9/1984 | Lebowitz . | |
| 2,821,038 | 1/1958 | Gee . | |
| 2,982,593 | 5/1961 | Chambers . | |
| 3,063,496 | 11/1962 | Kessler . | |
| 3,700,385 | 10/1972 | Sherwood | 52/823 X |
| 3,834,101 | 10/1974 | Wilder et al. | 52/823 X |
| 4,432,170 | 2/1984 | Hewell . | |
| 4,453,327 | 6/1984 | Clarke . | |
| 4,754,582 | 7/1988 | Cameron | 52/27 |

FOREIGN PATENT DOCUMENTS

| | | |
|---|---|---|
| 2355975 | 2/1978 | France . |

*Primary Examiner*—David A. Scherbel
*Assistant Examiner*—Creighton Smith
*Attorney, Agent, or Firm*—Walter J. Blenko, Jr.; David V. Radack

[57] ABSTRACT

A telephone booth enclosure which has arcuate vertical walls which can contain advertising material. The arcuate vertical walls have an inside sidewall made of perforated stainless sheet, an outside sidewall made of transparent material and an interposed fiberglass material. The vertical walls have front, rear, top and bottom edge walls, the front edge wall being a removable aluminum extrusion. The advertising material is placed in the vertical wall by first removing the front edge wall and then sliding it underneath the transparent material.

13 Claims, 2 Drawing Sheets

TELEPHONE ENCLOSURE

My invention relates to a telephone enclosure that is easy to assemble and which contains advertising material that can be displayed on an outside facing wall. My telephone enclosure is also designed to acoustically insulate the user so as to enhance effective use of the telephone.

It is known to provide a telephone enclosure having advertising displayed thereon. My U.S. Pat. No. 4,754,582 discloses a telephone enclosure having sidewalls which are in the form of box-like enclosures having one or more advertising displays. The advertising displays consist of transparent sheets which are mounted in a hinged sidewall framing member. A light source means, disposed inside the box-like enclosure, illuminates the advertising.

It is also known to provide a telephone enclosure having two arcuate sidewall panels and a backwall on which a telephone is mounted. This enclosure has a top cap member that is in the form of a partially truncated cylinder. U.S. Des. Pat. No. D273,637. It is said that this design protects the user from high noise levels, such as at train stations, convention centers, and stadiums. That enclosure does not have advertising on the side panels. Also, that enclosure is a one piece design that is very cumbersome to install and repair.

I provide a telephone enclosure that has arcuate vertical walls on which advertising displays can be mounted. The arcuate vertical walls have an inner sidewall which can be perforated stainless steel, an outer transparent sheet, and an interposed fiberglass material. I further provide that the arcuate sidewalls are easily removable from the backwall of the enclosure. I may provide a circular top cap member on my enclosure which not only serves to protect the user from the outside elements elements (rain, snow) but also provides another advertising display.

I further provide that my arcuate sidewalls have a removable front edge wall that is an aluminum extrusion. The aluminum extrusion can be removed so that the advertising display can be placed underneath the transparent material and on top of the fiberglass material. I further provide an optional writing shelf mounted on the backwall above the telephone.

In the accompanying drawings, I have illustrated a present preferred embodiment of my invention in which.

Figure 1:
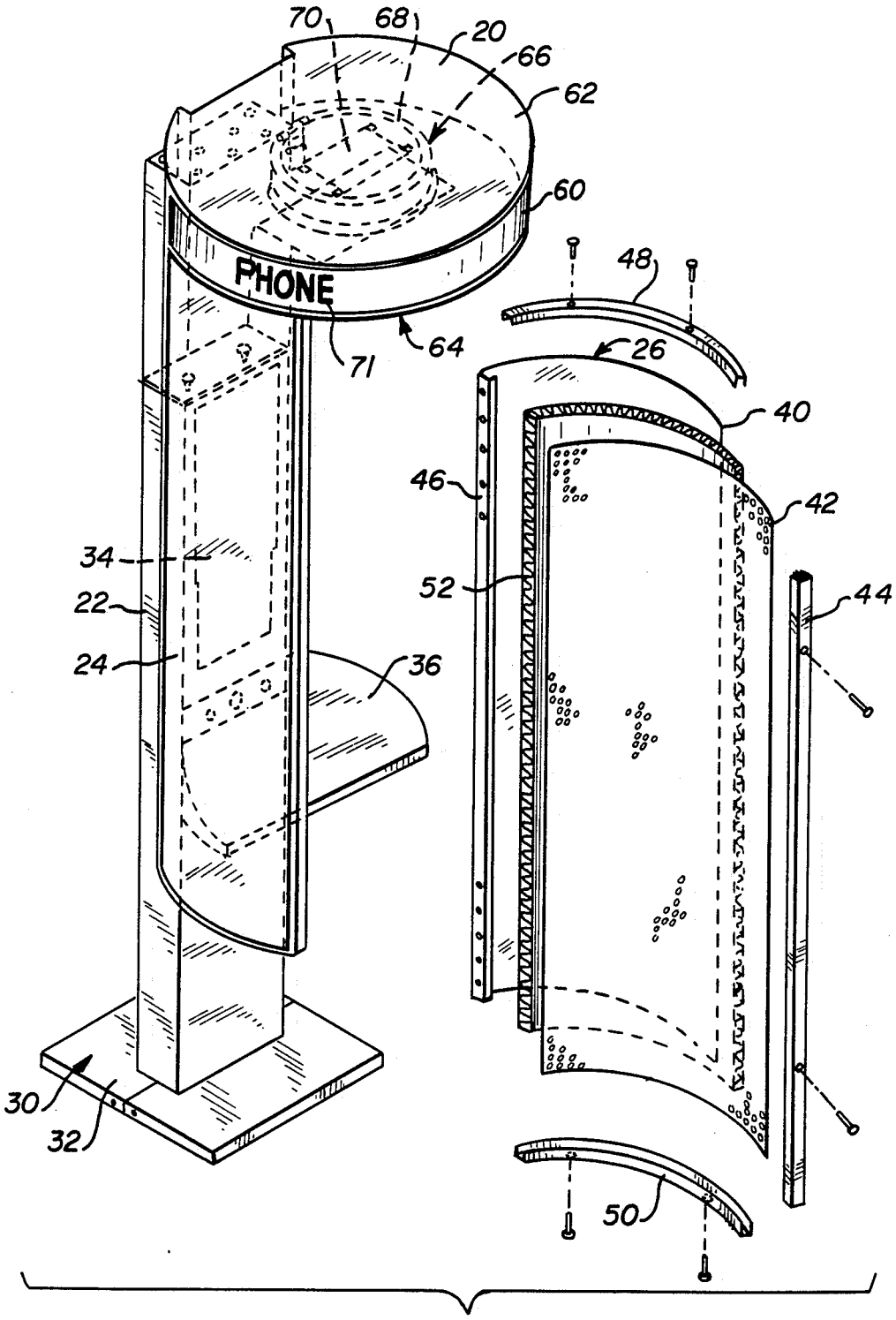
FIG. 1 is a perspective exploded view partially in section of a telephone enclosure embodying the present invention.

Referring more particularly to FIG. 1, the telephone booth of the present invention is essentially comprised of a top cap member 20, a backwall 22 and left and right vertical arcuate walls 24 and 26. In the illustrated embodiment, this structure is supported by a pedestal 30 that includes a base plate 32 which is bolted or otherwise suitably secured to the floor. The telephone itself (which is not shown) is normally mounted on the backwall 22 at the approximate location shown by the phantom lines at 34. The interior of the booth is also provided with a conventional slanted writing shelf 36 which is bolted or otherwise suitably secured to the backwall 22.

The arcuate vertical walls 24 and 26 are identical to each other and therefore only one need be described. Each vertical wall has an outside sidewall 40, an inside sidewall 42, a front edge wall 44, a back edge wall 46, a top edge wall 48, and a bottom edge wall 50. A fiberglass material 52 is disposed between the outside sidewall 40 and the inside sidewall 42. The various parts of the arcuate vertical walls are secured together by screws. The entire arcuate vertical wall 26 is attached to the backwall. The arcuate sidewalls will be discussed in further detail in reference to FIGS. 2 and 3.

The top cap member 20 is mounted on top of the two vertical arcuate walls 24 and 26 and on top of the backwall 22. The top cap member 20 is cylindrical in shape and includes a circular sidewall 60, a top wall 62 and bottom wall 64. Disposed within the top cap member is a florescent light means 66 which includes a conventional circle line bulb 68 and other conventional florescent light fixtures such as a ballast 70. The circular sidewall 60, the top wall 62, and the bottom wall 64 are preferably composed of a translucent material such as plastic. These parts can include indicia 71 such as the word "Phone". Other indicia such as advertising can be placed on the circular sidewall 60 or circular bottom wall 64, if desired.

Figure 2:
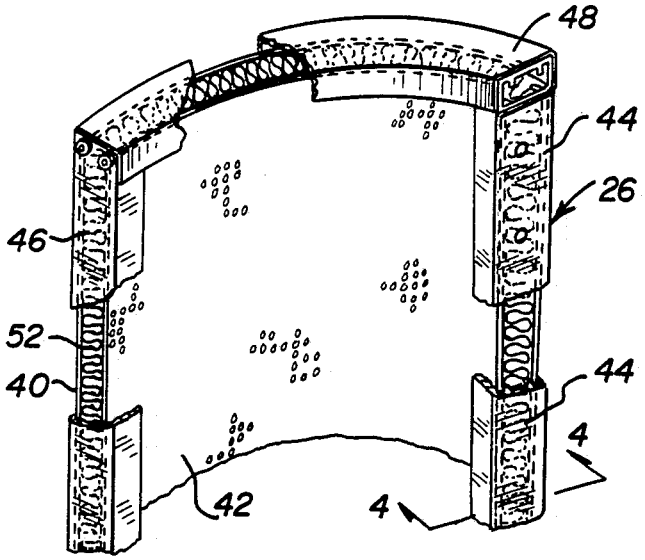
FIG. 2 is a perspective view, partially in section, of one vertical walls of FIG. 1.

Referring now to FIG. 2, the arcuate sidewall 26 has an inside sidewall 42 consisting of a perforated stainless steel panel. The perforated stainless steel panels enhance acoustical properties and also increase vandal resistance. FIG. 2 also shows the fiberglass material 52 which is sandwiched between the perforated panel 42 and the outer sidewall 40. Acoustic foam can also be used, however, fiberglass is preferred because it is more rigid.

Figure 3:
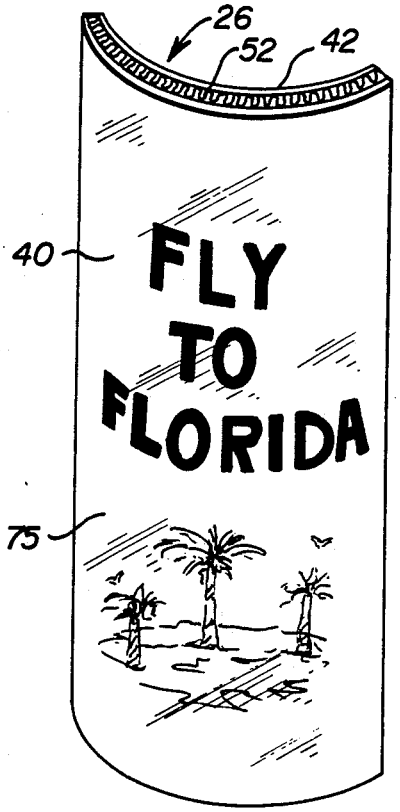
FIG. 3 is a perspective view, partially in section, of the side of the arcuate vertical wall shown in FIG. 2.

FIG. 3 shows the opposite side of the vertical arcuate wall 26 and shows clearly the outside sidewall 40. The outside wall 40 is preferably made of a transparent material, such as Lexan®, a registered Trademark (U.S. Trademark Registration Nos. 637,022 and 902,420) of General Electric, or glass. FIG. 3 also shows the advertising display 75 which is mounted underneath the outside wall 40 and on top of the fiberglass material 52. This advertising display 75 can be mounted on paper or poster board. The advertising material 75 is protected by the outside sidewall 40 and thus will not get vandalized or stolen.

Figure 4:
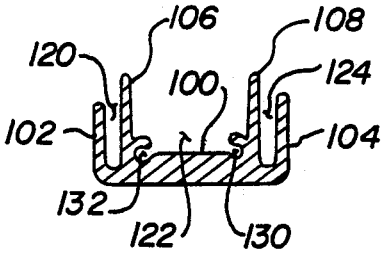
FIG. 4 is a horizontal sectional view through the front edge wall taken on line 3—3 of FIG. 2.

Referring now to FIG. 4, there is seen the cross section of the front edge wall 44. The front edge wall 44 is preferably an aluminum extrusion. It will be appreciated that the rear edge wall 46 will have the same configuration as the front edge wall 44. It will also be appreciated that the top edge wall 48 and the bottom edge wall 50 will also have the same configuration, the only difference being that the top 48 and the bottom 50 edge walls will be in arcuate or curved aluminum extrusion, whereas the front 44 and rear 46 edge walls are straight aluminum extrusions.

The aluminum extrusion consists of a base 100 and two end walls 102, 104. The extrusion also has two intermediate walls 106, 108. The intermediate wall 106 and end wall 102 define a first side channel 120. The two intermediate members 106 and 108 define an intermediate central channel 122 and the intermediate member 108 and the end member 104 define a second side channel 124. The two intermediate members also define two screw hole members 130 and 132. As can be seen, the intermediate walls 106 and 108 extend a further distance from the base 100 than the two end walls 102, 104. This fact will be important when discussing the mounting of the front edge wall 44 on the vertical arcuate wall 26.

Referring back to FIG. 2, and now observing front edge wall 44, it can be seen that the inside sidewall perforated stainless steel panel 42 will fit into the first intermediate channel 120. The fiberglass material 52 will fit into the central channel 122 and the transparent outside sidewall will fit into the second side channel 124. The longer intermediate walls 106, 108 are designed to protect the fiberglass material 52 from damage due to water seepage.

It will be appreciated that this aluminum extrusion can be used with other vertical sidewalls, not just arcuate vertical sidewalls. Therefore, the unique aluminum extrusion can be used with conventional straight vertical sidewalls or with sidewalls having any other configuration.

Figure 5:
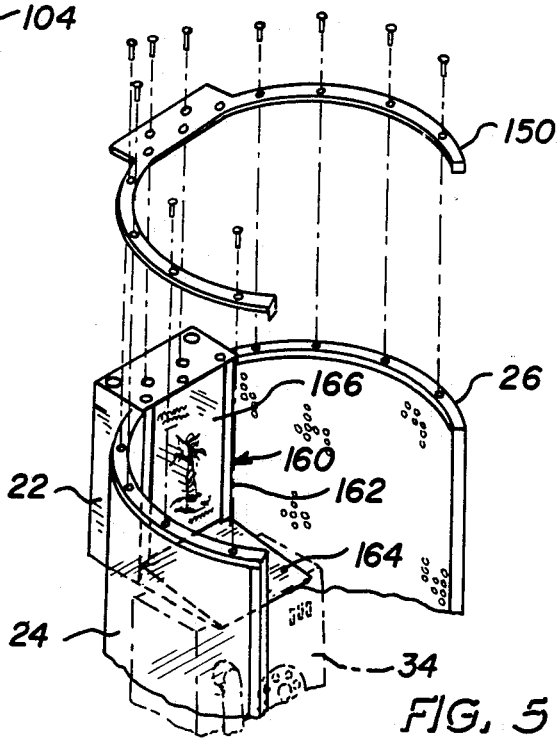
FIG. 5 is a partial perspective view of another embodiment of the telephone enclosure, partially in section, showing the writing shelf means.

Referring now to FIG. 5, another embodiment of my invention is shown. The top cap member 20 is not mounted on the backwall 22 and the two sidewalls 24 and 26 of the enclosure. The top cap member 20 is optional and will not be used in some indoor installations, for example. In this embodiment, a reinforcing horseshoe-shaped bracket 150 is mounted as by screws on the top of the vertical arcuate wall 24, 26 and the backwall 22.

This embodiment also shows my optional writing shelf means 160 that is mounted above the telephone shown in phantom at 34. The writing shelf means 160 consists of an advertising card holder 162 and a slanted small writing shelf 164. The advertising card holder 162 is designed to hold an advertisement card 166 therein. The entire writing shelf means is bolted onto the backwall as is shown in FIG. 5.

It will be appreciated that the method of the invention involves the steps of first providing a telephone enclosure having sidewalls with a front edge wall being a removable aluminum extrusion. After this the advertising display shown in FIG. 3 is replaced by merely removing the front edge wall aluminum extrusion by taking the screws out of the front edge aluminum extrusion and then sliding the advertising material so that it is on top of the fiberglass material and underneath the transparent outside sidewall 40. Finally, the front edge wall is replaced by fastening the screws to the vertical arcuate walls.

While I have illustrated and described a present preferred embodiment of the invention, it is to be understood that the invention is not limited thereto and may be otherwise variously practiced within the scope of the following claims.

I claim:

1. A telephone enclosure adapted to be mounted on a pedestal or a wall or the like, said telephone enclosure comprising a backwall adapted to receive a telephone set and having an upper portion and a lower portion, and a pair of vertical arcuate walls mounted on opposite sides of said backwall and projecting forward from said backwall, the improvement which comprises at least one vertical arcuate wall having arcuate inside and outside sidewalls, arcuate top and bottom edge walls, and front and rear edge walls, at least one of said outside and inside arcuate sidewalls including a transparent sheet material whereby advertising display material can be mounted underneath said transparent sheet material, said front edge wall is an elongated aluminum extrusion which is removably attached to said vertical arcuate wall, said elongated aluminum extrusion has a base, two end walls, and two intermediate walls, whereby a central channel is defined by said intermediate walls, a first side channel is defined by one said end wall and an adjacent said intermediate wall, and a second side channel is defined by the other said end wall and the other said intermediate wall, said intermediate walls extends from said base a greater distance than said end walls, said inside sidewall is mounted in said first side channel, an insulating material is in said central channel and said outside sidewall is mounted in said second side channels, and said inside sidewall is a perforated stainless steel panel and said outside sidewall being a transparent sheet material.

2. The telephone enclosure of claim 1, including screw holes defined by a portion of said aluminum extrusion.

3. The telephone enclosure of claim 1, wherein said aluminum extrusion is removable from said arcuate vertical wall, whereby said advertising display material can be placed on top of said fiberglass material and beneath said transparent material.

4. The telephone enclosure of claim 3, wherein said insulating material is acoustic foam or fiberglass.

5. The telephone enclosure of claim 4, wherein said transparent material is glass or plastic.

6. A telephone enclosure adapted to be mounted on a pedestal or a wall or the like, said telephone enclosure comprising a backwall adapted to receive a telephone set and having an upper portion and a lower portion, and a pair of vertical arcuate walls mounted on opposite sides of said backwall and projecting forward from said backwall, the improvement which comprises at least one vertical arcuate wall having arcuate inside and outside sidewalls, arcuate top and bottom edge walls, and front and rear edge walls, at least one of said outside and inside arcuate sidewalls including a transparent sheet material whereby advertising display material can be mounted underneath said transparent sheet material, at least one of said bottom and top edge walls is an elongated arcuate aluminum extrusion which is removably attached to said vertical arcuate wall, said arcuate aluminum extrusion has an arcuate base, two arcuate end walls, and two arcuate intermediate walls, whereby a central arcuate channel is defined by said arcuate intermediate wall, a first arcuate side channel is defined by one said arcuate end wall and an adjacent said intermediate wall and a second arcuate side channel is defined by the other said end wall and the other said intermediate wall, said inside sidewall is mounted in said first arcuate side channel, said insulating material is disposed in said central arcuate channel, and said outside sidewall is mounted in said second arcuate side channel, and said inside sidewall is a perforated stainless steel panel and said outside sidewall is a transparent sheet material.

7. The telephone enclosure of claim 6, including screw holes defined by a portion of said aluminum extrusion.

8. The telephone enclosure of claim 7, wherein said arcuate aluminum extrusion is removable from said arcuate vertical wall, whereby said advertising display can be placed on top of said fiberglass material and beneath said transparent material.

9. The telephone enclosure of claim 8, wherein said insulating material is an acoustic foam or fiberglass.

10. The telephone enclosure of claim 9, wherein said transparent material is glass or plastic.

11. A telephone enclosure adapted to be mounted on a pedestal or a wall or the like, said telephone enclosure comprising a backwall adapted to receive a telephone set and having an upper portion and a lower portion, and a pair of vertical arcuate walls mounted on opposite sides of said backwall and projecting forward from said backwall, the improvement which comprises at least one vertical arcuate wall having arcuate inside and outside sidewalls, arcuate top and bottom edge walls, and front and rear edge walls, at least one of said outside and inside arcuate sidewalls including a transparent sheet material whereby advertising display material can be mounted underneath said transparent sheet material, a circular top cap member mounted near said upper portion of said backwall and on the top edge wall of said arcuate vertical panels, and a light source disposed inside said top cap member.

12. The telephone enclosure of claim 11, wherein said top cap member has translucent panels with indicia printed thereon.

13. A method of placing advertising material in a telephone enclosure including the steps of providing a telephone enclosure adapted to be mounted on a pedestal or a wall or the like, said telephone enclosure comprising a backwall adapted to receive a telephone set and a pair of vertical walls mounted on opposite sides of said backwall and projecting forward from said backwall, at least one vertical wall having inside and outside sidewalls, front and rear edge walls and bottom and top edge walls, said front edge wall being a removable aluminum extrusion, having a base, two end walls, and two intermediate walls, whereby a central channel is defined by said intermediate walls, a first side channel is defined by one said end wall and an adjacent said intermediate wall and a second side channel is defined by the other said end wall and the other said intermediate wall, said inside sidewall being mounted in said first side channel, an insulating material being disposed in said central channel and said outside sidewall being mounted in said second side channel, removing said front edge wall, placing advertising material underneath one of said inside and outside sidewalls and on top of said insulating material, replacing said front edge wall, providing said aluminum extrusion with screw holes, providing screws to hold the extrusions together, removing said screws to remove said front edge wall, and replacing said screws to replace said front edge wall.

* * * * *